United States Patent [19]

Keifer

[11] Patent Number: 4,620,182

[45] Date of Patent: Oct. 28, 1986

[54] SECURITY APPARATUS FOR RETAIL GOODS

[75] Inventor: Terry A. Keifer, Reading, Pa.

[73] Assignee: Check Mate Systems, Inc., Reading, Pa.

[21] Appl. No.: 690,346

[22] Filed: Jan. 10, 1985

[51] Int. Cl.[4] ..... G08B 13/12

[52] U.S. Cl. ..... 340/568; 340/687

[58] Field of Search ..... 340/568, 687

[56] References Cited

U.S. PATENT DOCUMENTS 3,253,270 5/1966 Downer ..... 340/568

3,742,480 6/1973 Hoecker ..... 340/568

*Primary Examiner*—Glen R. Swann, III

*Attorney, Agent, or Firm*—Eugene E. Renz, Jr.

[57] ABSTRACT

A security device for use in retail stores for the prevention of retail theft, which includes an alarm mechanism which generates an alarm signal in response to electrical power being applied through a switch mechanism. The switch mechanism is controlled by a signal provided by a closed circuit mechanism. Whenever a closed circuit condition is created, for example, by cutting the cable which mechanically connects the retail item to the security device, electrical power is applied to the alarm mechanism. Thus, if a battery is used to supply electrical power, such battery is only drained during closed circuit conditions, maximizing battery life.

8 Claims, 5 Drawing Figures

SECURITY APPARATUS FOR RETAIL GOODS

FIELD OF THE INVENTION

The instant invention relates to security devices and particularly to security devices used in retail stores for the prevention of the retail theft.

BACKGROUND OF THE INVENTION

In recent times, the rise of retail theft has reached staggering proportions, particularly, the theft of retail clothing. Clothing is especially susceptible to this type of crime because it cannot be sold from within a display case, as can jewelry, cameras or calculators. Clothing sales are primarily made by displaying the garments on open racks such that customers may put on the clothing to determine proper fit and may view themselves in the clothing to determine the appropriate aesthetic appeal.

In order to deter customers from walking off with merchandise, various devices have been developed. A typical scheme involves threading a single steel cable through all garments on a single rack with the ends of the cable secured by a locking mechanism to the rack. The disadvantages associated with such a device will be quickly appreciated. Garments are not capable of being put on by the customer nor are they capable of purchase until such cable is removed. With jackets and coats, such a removal and reinsertion process for the steel cable is both time consuming and not conducive to so-called impulse sales. In an effort to solve the single cable problem, devices have been developed for securing a plurality of cables to a single rack, with each cable attached to a separate garment.

The problem with steel cable security systems is they can be quickly and quietly defeated by merely cutting the cable. In an attempt to solve this problem devices have been developed which substitute for the steel cable, a conductive cable having at least two leads joined at the cable end farthest from the device to provide in effect a conductive loop. An electrical current is continuously passed through the conductive cable so that any break in the cable results in an open circuit being sensed by the device, which in turn sets off an alarm. The problem with such devices lies in the use of batteries to provide the continuous current through the cable. Batteries are, of course, preferred because they are not susceptible to power outages, tampering, and the like. However, due to continuous current drain, batteries must be frequently replaced which is costly and further which requires retailers to be ever vigilant to whether batteries have lost power.

A further problem with the continuous current system is the ease with which it can be defeated. The insertion of a straight pin through the cable typically maintains the continuous current through the cable, effectively masking any break occurring past the pin location.

Accordingly, it is an object of the invention to provide a security system for use in the prevention of theft of retail items.

A further object of the invention is to provide a security device for use with retail items which incorporates battery power, but which a provides for a maximum battery life.

It is still another object of the invention to provide a security system which is not easily defeated.

It is yet another object of the invention to provide a security device which minimizes the impact on so-called impulse sales or on the spontaneity of retail sales.

BRIEF SUMMARY OF THE INVENTION

These and other objects are accomplished by a security device for use with the display of retail items for the prevention of retail theft which includes an alarm mechanism which generates an alarm signal in response to electrical power being applied thereto, a switch mechanism interposed between a source of electrical power and the alarm mechanism, which switch mechanism allows and interrupts the passage of electrical power to the alarm mechanism in response to a switch signal, and a closed circuit switch mechanism interposed between a source of electrical power and the switch mechanism and which is capable of mechanical connection to the retail item, which closed circuit switch mechanism provides a switch signal to the switch mechanism whenever the mechanical connection is broken, so that electrical power is not passed from the source to the alarm mechanism until the connection is broken, thereby preserving the source of electrical power.

BRIEF DESCRIPTION OF THE DRAWINGS

Further characteristics and advantages of the invention will be seen better in a detailed description of a preferred embodiment, given as a non-limiting example, and illustrated by the attached sheets of drawings in which.

DETAILED DESCRIPTION OF THE PREFERRED EMBODIMENT

Figure 1:
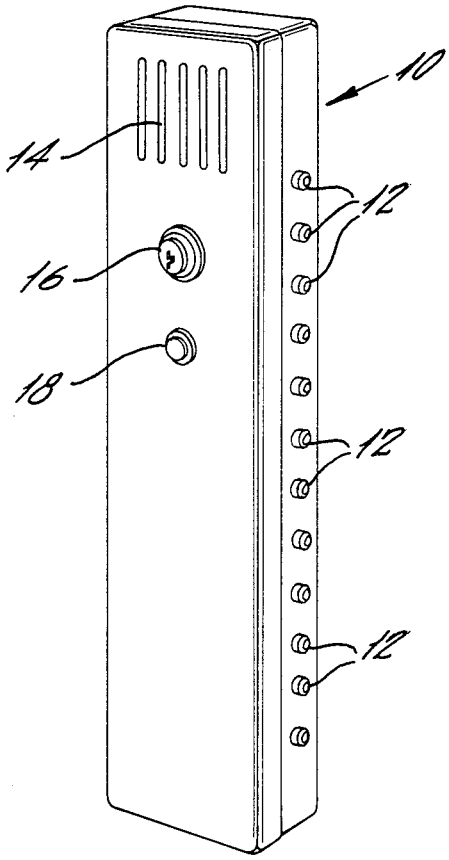
FIG. 1 is a perspective view of the invention, wherein cables connecting the device to retail items are not shown.
Figure 2:
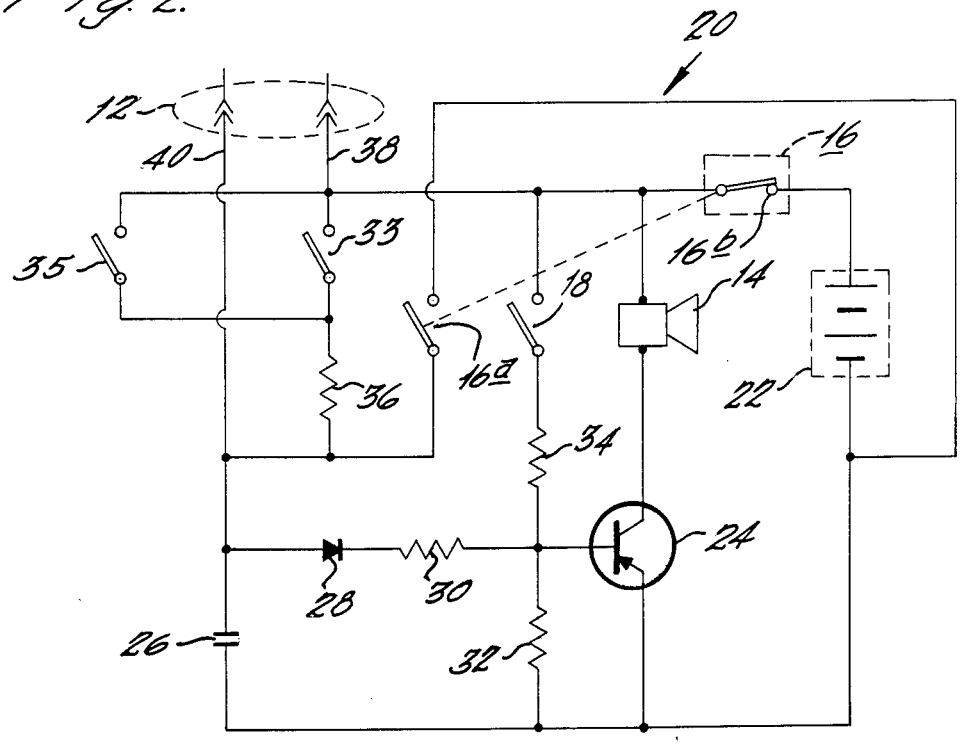
FIG. 2 is a schematic diagram of the electronic circuit used by the instant invention.

A security apparatus for use with the display of retail items for the prevention of retail theft is shown in FIG. 1 and is generally referred to by the numeral 10. The security device is shown to include a plurality of input ports 12 for the insertion of cable assemblies, more clearly shown in FIGS. 3 and 4. Security device 10 is also shown as including an audio alarm mechanism 14 for generating an alarm discernible by retail clerks. As will be described more fully herein, such alarm is sounded whenever the cable connected to one of the ports 12 is improperly removed, or when tampering with such cable occurs. The security device is also shown to include a key operated locking mechanism 16 whereby only authorized personnel may arm or disarm the device. A test button 18 is provided to periodically determine whether the battery-operated device still maintains sufficient power to set off alarm mechanism 14. FIG. 2 discloses the interrelationship of these features in greater detail in an electrical circuit 20 utilized in practicing the preferred embodiment of the instant invention.

The circuit 20 is seen to include a battery 22 and transistor 24. The battery and transistor are arranged in a series loop with alarm mechanism 14 and switch 16*b*. Switch 16*b* is one pole of a double pole, double throw key operated switch 16 identified in FIG. 1. As will be appreciated, when a signal is applied to a base of transistor 24, the transistor acts as a switch mechanism wherein current is allowed to flow through alarm mechanism 14 from battery 22. The remainder of the electronic circuit provides several closed circuit switch mechanisms for the provision of a switch signal to the base of transistor 24 when a closed circuit condition occurs.

A voltage signal is applied to the base of transistor 24 by charging capacitor 26. The charge from capacitor 26 passes through diode 28 where it is divided between resistor 30 and resistor 32. The values of resistors 30 and 32 are selected so that a sufficient voltage is applied to transistor 24 to make it conductive and to provide a predetermined time for discharging capacitor 26. It will be noted that test button 18 is a normally open momentary test switch which is used to activate the alarm while the button is depressed to check the condition of battery 22. Since it is not desirable to charge capacitor 26 for a momentary test, diode 28 is aligned to prevent current flow created by the closing of switch 18 from reaching capacitor 26. When switch 18 is closed, the voltage is divided between resistors 32 and 34. Accordingly, the value of resistor 34 is selected on the basis of providing sufficient voltage to transistor 24 making it conductive.

Pole 16*a* of the double pole, double throw key operated switch 16 is shown in FIG. 2 as being a normally open switch. When switch 16 is "unlocked" or "disarmed", switch 16*a* closes thereby connecting both sides of capacitor 26 to the negative terminal of battery 22. When switch 16*a* is in this closed position, no signal appearing at inputs 12 will result in a signal being applied to the base of transistor 24 which in turn would set off alarm 14. Conversely, circuit 20 is "armed" by opening switch 16*a*.

In the preferred embodiment, access to battery 22 is through a trap door arrangement, not shown in the drawings. To prevent tampering with battery 22, a lever switch 33 has been provided. Switch 33 is mechanically attached to the battery access door such that when the door is opened, switch 33 closes. During normal operation wherein the battery access is closed, switch 33 is open. Thus, unauthorized removal of battery 22 cannot be accomplished without sounding alarm 14.

An optional normally open switch 35 is also provided in circuit 20. Switch 35, in fact, represents a spring operated switch which is held open by a plunger, or the like, passing through the side of security apparatus 10 which has been mounted to a clothing rack. Removal of security device 10 from the clothing rack or other mounting frame, results in switch 35 closing which in turn passes a current through resistor 36 and charges capacitor 26. Once capacitor 26 has been charged, alarm 14 will sound. Thus, switch 35 prevents tampering or removal of security apparatus 10 from its mounted position.

Figure 3:
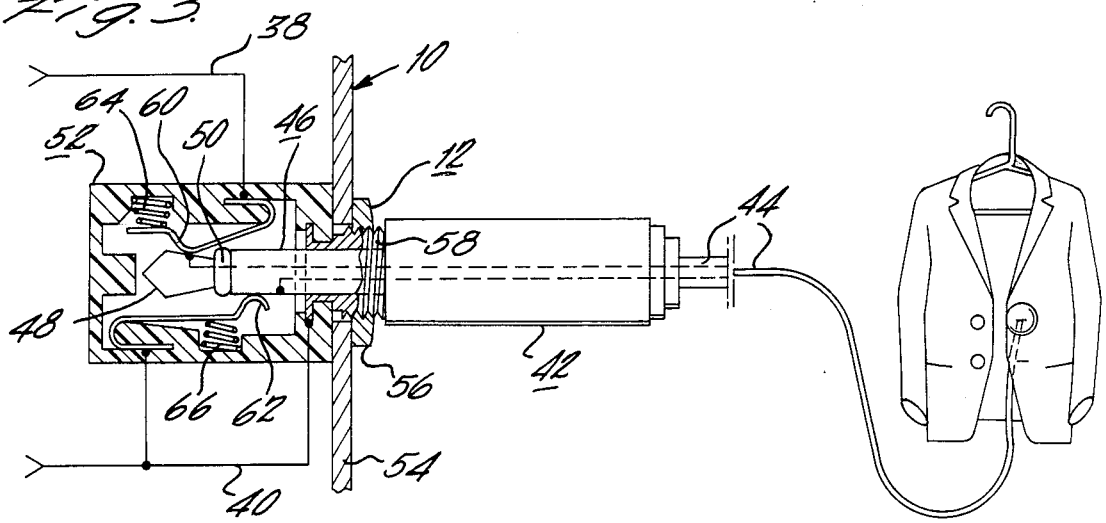
FIG. 3 is partial sectional view of an input of the device shown in FIG. 1 wherein the plug end of the cable which connects the device to a retail item is shown fully inserted.
Figure 4:
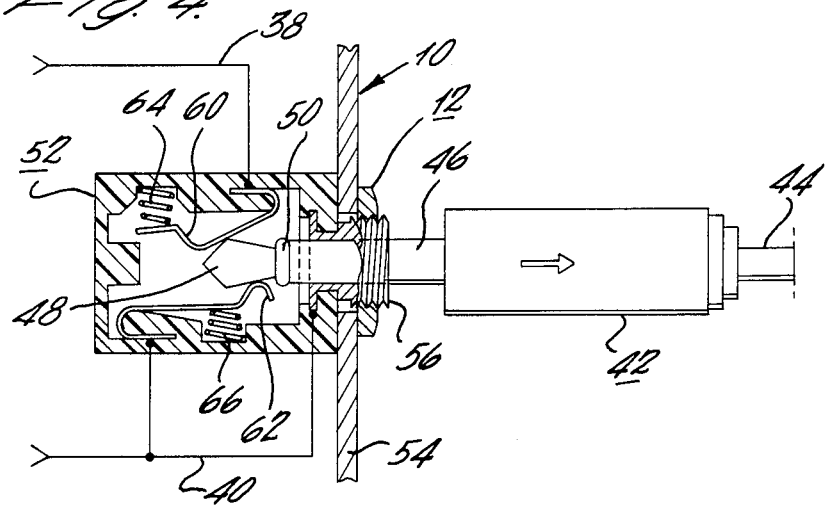
FIG. 4 is the same partial sectional view shown in FIG. 3, wherein the plug is only partially inserted.

Inputs 12, which together with their plug and jack assemblies are shown in greater detail in FIGS. 3 and 4, are electrically connected to circuit 20 by leads 38 and 40. FIG. 3 shows an input 12 wherein plug 42 is fully inserted. While only one input will be described herein, it should be understood that each of the inputs 12 are of a similar configuration. Plug 42 serves as a housing and support for cable 44 which in the preferred embodiment is a coaxial cable such as Columbia FLEX FOAM 1359 manufactured by Columbia Electronic Cables of Pawtucket, R.I. Each of the conductive elements in cable 44 are electrically connected to one of the conductive portions of the male member of the plug 42. Plug 42 is seen to include a shank conductive portion 46 and a tip conductive portion 48, which are separated by insulator 50.

Plug 42 is mounted into a jack 52 which is secured to frame 54 of the security apparatus 10 by a mounting nut 56. Mounting nut 56 is screwed onto a threaded conductive member 58 which is securely attached to jack 52 by friction or any other suitable means.

Jack 52 is shown to include two conductive tongues 60, 62. Tongues 60, 62 are spring biased towards the tip and shank portions of plug 42 by springs 64, 66 respectively. Thus, it will be appreciated that when plug 42 is fully inserted, conductive lead 38 is electrically connected to the tip portion of plug 42, which in turn is electrically connected to one of the conductive leads in coaxial cable 44. It is also shown that when plug 42 is fully inserted, conductive lead 40 is electrically connected to shank portion 46, which in turn is electrically connected to the other conductive lead of coaxial cable 44. It has been discovered that cutting the FLEX FOAM 1359, even with non-conductive shears, will cause the conductive leads to come into contact with each other creating a closed circuit condition. In the instant invention such a condition results in voltage being applied to capacitor 26. Since the closed circuit condition may only be momentary, it is preferred that a transistor of CMOS construction be used, or in the alternative, uses of a transistor requiring relatively little current applied to the base to make it conductive. The use of such a transistor will ensure the sounding of alarm 14 for a significant time, even though the closed circuit condition only exists momentarily. While the instant invention is not limited to FLEX FOAM 1359 coaxial cable, it is necessary that the selection of cable be such that a cut in the cable causes two isolated conductive elements in the cable to come into contact.

As shown in FIG. 4, the removal of plug 42 also serves to set off alarm 14. As plug 42 is removed, springs 64 and 66 force conductive elements 60 and 62 to simultaneously contact tip portion 48. Since tip portion 48 is conductive, a closed circuit is created between conductive leads 38 and 40, which in turn charge capacitor 26 setting off alarm 14. Consequently, the only method for removing any plug 42 from any input 12 is by closing switch 16*a* through key switch 16.

Figure 5:
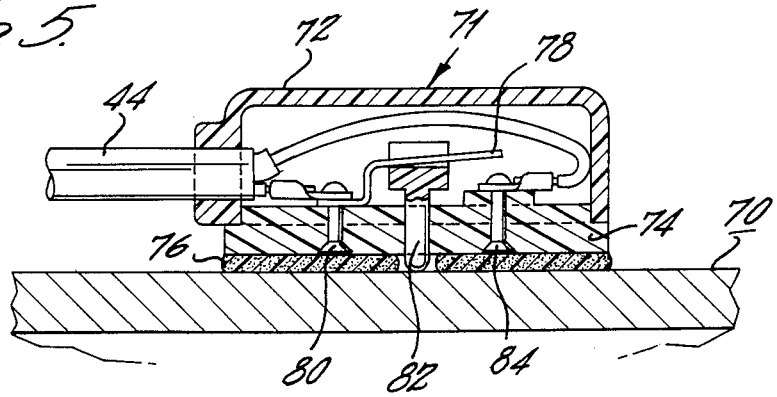
FIG. 5 is a mechanical connection device for mechanically connecting the cable of FIGS. 3 or 4 to the surface of a retail item.

FIG. 5 discloses a switch device 71 capable of creating a closed circuit condition between the conductive leads of coaxial cable 44, which is attached to the exterior of retail items 70 such as computers, calculators, cameras or the like. The switch has a housing which includes cover member 72 which is securely attached to base member 74. Interposed between base member 74 and retail item 70 is a double faced adhesive foam pad 76. As is shown in the drawing, the outer conductive sheath portion of coaxial cable 44 is attached to conductive element 78 by connecting rivet 80. Conductive element 78 in the preferred embodiment is a biasable, springy metal element. This element is connected to plunger 82 which passes through base 74, adhesive pad 76 and comes into contact with the exterior of retail item 70. While this switch remains in contact with retail item 70, plunger 82 forces conductive element 78 away from conductive rivet 84. Rivet 84 is connected to the central wire of coaxial cable 44. It will be appreciated that if the switch device is removed from retail item 70, conductive element 78 will no longer be biased away from rivet 84 and will come into contact therewith creating a closed circuit condition between the conductive elements of coaxial cable 44. This, in turn, charges capacitor 26 which enables alarm 14. Although not shown in the drawings, cable 44 can also be attached to retail items by any secure and conventional means, as long as the conductive elements therein do not come into contact. For example, cable 44 may have a large plastic disc securely attached to its end. The plug end of cable 44 is passed through an opening in the retail item, e.g. a buttonhole in a garment, and inserted into one of the inputs 12.

Thus, it will be appreciated that either the removal of switch 71 from retail item 70 or the removal of plugs 42 from inputs 12 or cutting cable 44 will result in the sounding of alarm mechanism 14. Until such plug or switch is removed or until coaxial cable 44 is broken, no energy is drained from battery 22. Thus, the usable life of battery 22 is maximized.

While the invention is susceptible to various modifications and alternative forms, a specific embodiment has been shown and described herein. It should be understood, however, that it is not intended to limit the invention to the particular embodiment disclosed but, on the contrary, the intention is to cover all modifications, equivalents and alternatives falling within the spirit and scope of the invention as defined by the appended claims.

I claim:

1. A security apparatus, for use with the display of retail items for the prevention of retail theft, comprising:

an alarm mechanism which generates an alarm signal in response to electrical power being applied thereto;

first switch means, interposed between a source of electrical power and said alarm mechanism, for allowing and interrupting the passage of electrical power to said alarm mechanism in response to a switch signal; and second switch means responsive to a closed circuit, connected electrically between a source of electrical power and said first switch means and capable of mechanical connection to said retail items, for providing a switch signal to said first switch means when said mechanical connection is broken, such that said source does not provide electrical power to said alarm mechanism until said mechanical connection is broken, thereby preserving said source of electrical power, said second switch means including a cable having two insulated conductive elements co-extensive therein, wherein one end of said cable is mechanically connected to said retail item and wherein the other end of said cable has one conductive element electrically connected to said source of electrical power and the other of said conductive elements electrically connected to said first switch means, whereby if said cable is cut, said conductive elements are caused to contact forming a closed circuit between said source of electrical power and said first switch means, thereby providing a switch signal.

2. The apparatus of claim 1, wherein said cable having two insulated conductive elements co-extensive therein comprises coaxial cable.

3. The apparatus of claim 1, wherein said switch means comprises a transistor, of which the emitter and collector are electrically connected between said source of electrical power and said alarm mechanism and of which the base is electrically connected to said second switch means responsive to a closed circuit, such that when a switch signal is applied to said base said transistor becomes conductive allowing electrical power to pass from said source to said alarm mechanism.

4. The apparatus of claim 1, wherein said cable is mechanically connected to said retail item by a button mechanism, wherein removal of the button results in a closed circuit connection between said conductive elements.

5. The apparatus of claim 4, wherein said button mechanism comprises a housing having an opening on the underside thereof, a layer of pressure sensitive adhesive applied to said underside for affixing said button mechanism to said retail item, a spring biased plunger positioned to extend through said opening when said button mechanism is not affixed to retail item, electrical contacts connected to said plunger and to said housing such that when said plunger extends through said opening said electrical contacts touch, and wherein said conductive elements are connected separately to each contact.

6. The apparatus of claim 1, wherein said cable is electrically connected to said source of electrical power and said switch means by a plug and receptacle assembly, wherein as said plug is removed from said receptacle a closed circuit connection between said conductive elements occurs.

7. A security apparatus according to claim 6, wherein said plug includes an insertion member which comprises two insulated portions, and wherein said receptacle includes two spring contacts, whereby when said plug is fully inserted, a contact is electrically connected to one conductive element while the other contact is electrically connected to the other conductive element, and when said plug is partially removed said two spring contacts are electrically connected to each other to form a closed connection between said conductive elements.

8. A security apparatus, for use with the display of retail items for the prevention of retail theft, comprising:

an alarm mechanism which generates an alarm signal in response to electrical power being applied thereto;

first switch means, interposed between a source of electrical power and said alarm mechanism, for allowing and interrupting the passage of electrical power to said alarm mechanism in response to a switch signal; and second switch means responsive to a closed circuit, connected electrically between a source of electrical power and said first switch means and capable of mechanical connection to said retail items, for providing a switch signal to said first switch means when said mechanical connection is broken, such that said source does not provide electrical power to said alarm mechanism until said mechanical connection is broken, thereby preserving said source of electrical power, said second switch means including conductive means adapted to form a closed circuit between said source and said first switch means when said conductive means is cut, thereby providing a switch signal.

* * * * *